US010274882B2

(12) United States Patent
Yago

(10) Patent No.: US 10,274,882 B2
(45) Date of Patent: Apr. 30, 2019

(54) IMAGE FORMING APPARATUS CAPABLE OF CONTROLLING DENSITY OF OUTPUT IMAGE

(71) Applicant: CANON KABUSHIKI KAISHA, Tokyo (JP)

(72) Inventor: Toshihisa Yago, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/478,346

(22) Filed: Apr. 4, 2017

(65) Prior Publication Data

US 2017/0293237 A1 Oct. 12, 2017

(30) Foreign Application Priority Data

Apr. 6, 2016 (JP) ..... 2016-076404

(51) Int. Cl.
*G03G 15/00* (2006.01)
*G03G 15/01* (2006.01)
(Continued)

(52) U.S. Cl.
CPC ..... *G03G 15/5058* (2013.01); *G03G 15/01* (2013.01); *G03G 15/0131* (2013.01);
(Continued)

(58) Field of Classification Search
CPC ..... G03G 15/5058; G03G 15/01; G03G 15/0131; G03G 15/161; G03G 15/5045;
(Continued)

(56) References Cited

U.S. PATENT DOCUMENTS 5,497,221 A * 3/1996 Takemoto ..... G03G 15/5037 399/74
2009/0129800 A1* 5/2009 Omelchenko ..... G03G 15/0131 399/49

(Continued)

FOREIGN PATENT DOCUMENTS

CN 1869830 A 11/2006
CN 101995785 A 3/2011

(Continued)

OTHER PUBLICATIONS

Office Action issued in Chinese Appln. No. 201710215917.7 dated Feb. 22, 2019. English translation provided.

*Primary Examiner* — Ryan D Walsh
(74) *Attorney, Agent, or Firm* — Rossi, Kimms & McDowell LLP

(57) ABSTRACT

An image forming apparatus capable of controlling density of an output image with high accuracy regardless of variation of internal temperature. A controller controls an image forming unit to form a measurement image, controls a light receiving unit to receive reflected light from the measurement image, controls a conversion unit to convert an output value of the light receiving unit, and controls an image formation condition based on a value that is obtained by converting the output value. An adjustment unit controls the light receiving unit to receive reflected light from an image bearing member, and adjusts the emission light amount of an emission unit based on the reflected light from the image bearing member. A selection unit selects a conversion condition from among conversion conditions based on a reference temperature that is detected when the adjustment unit adjusts the emission light amount and a current temperature.

12 Claims, 11 Drawing Sheets

(51) Int. Cl.
*G03G 15/16* (2006.01)
*G03G 21/20* (2006.01)
*G03G 15/043* (2006.01)

(52) U.S. Cl.
CPC ..... *G03G 15/043* (2013.01); *G03G 15/161* (2013.01); *G03G 15/5045* (2013.01); *G03G 21/20* (2013.01); *G03G 2215/00042* (2013.01); *G03G 2215/00059* (2013.01); *G03G 2215/00755* (2013.01)

(58) Field of Classification Search
CPC ..... G03G 21/20; G03G 2215/00042; G03G 2215/00059; G03G 2215/00755
See application file for complete search history.

(56) References Cited

U.S. PATENT DOCUMENTS

| | | | | |
|---|---|---|---|---|
| 2011/0026953 | A1* | 2/2011 | Tomita | G03G 15/161 399/44 |
| 2011/0109920 | A1 | 5/2011 | Nakase | |
| 2015/0117912 | A1* | 4/2015 | Kamiyama | G03G 15/0131 399/301 |
| 2017/0070636 | A1* | 3/2017 | Sekiya | H04N 1/2346 |

FOREIGN PATENT DOCUMENTS

| | | | |
|---|---|---|---|
| CN | 102279535 | A | 12/2011 |
| CN | 104765255 | A | 7/2015 |
| JP | 2013167656 | A | 8/2013 |

* cited by examiner

ATMOSPHERE TEMPERATURE VS RELATIVE OPTICAL OUTPUT CHARACTERISTIC

IMAGE FORMING APPARATUS CAPABLE OF CONTROLLING DENSITY OF OUTPUT IMAGE

BACKGROUND OF THE INVENTION

Field of the Invention

The present invention relates to an image forming apparatus, such as a copying machine and a laser beam printer.

Description of the Related Art

In recent years, an image forming apparatus is required to increase quality of an output image. An environmental change and longtime use of an image forming apparatus may change density of an output image and may deteriorate image quality.

Accordingly, an image forming apparatus has a sensor that measures a measurement image, and controls an image formation condition so that density of an output image becomes ideal density on the basis of the measurement result of the sensor. For example, there is a known image forming apparatus that forms a measurement image at a predetermined timing, and controls an image formation condition for adjusting density of an output image on the basis of a measurement result of the measurement image by an optical sensor (Japanese Laid-Open Patent Publication (Kokai) No. 2013-167656 (JP 2013-167656A)).

However, when variation of internal temperature of the image forming apparatus changes temperature of the optical sensor, it was found that an output value of the optical sensor varies. Accordingly, when the internal temperature of the image forming apparatus rose and the temperature of the optical sensor rose during an operation of the image forming apparatus, the image forming apparatus may not enable to control the density of the output image to target density on the basis of the measurement result of the optical sensor.

SUMMARY OF THE INVENTION

The present invention provides an image forming apparatus that is capable of controlling density of an output image with high accuracy on the basis of a measurement result of a measurement image regardless of variation of internal temperature.

Accordingly, an aspect of the present invention provides an image forming apparatus including an image forming unit configured to form an image on a sheet, an image bearing member on which a measurement image is formed, an emission unit configured to emit light to the image bearing member, a light receiving unit configured to receive reflected light from the image bearing member and to output an output value corresponding to a light receiving result, a conversion unit configured to convert the output value output by the light receiving unit using a conversion condition, a controller configured to control the image forming unit to form the measurement image, to control the emission unit to emit light, to control the light receiving unit to receive the reflected light from the measurement image, to control the conversion unit to convert the output value corresponding to the light receiving result of the reflected light from the measurement image, and to control the image formation condition for the image forming unit based on a value that is obtained by converting the output value corresponding to the light receiving result of the reflected light from the measurement image by the conversion unit, an adjustment unit configured to control the emission unit to emit light, to control the light receiving unit to receive reflected light from the image bearing member, and to adjust the emission light amount of the emission unit based on the light receiving result of the reflected light from the image bearing member, a detection unit configured to detect temperature of the image forming apparatus, and a selection unit configured to select a conversion condition from among a plurality of conversion conditions based on the temperature detected by the detection unit. The selection unit selects a conversion condition from among the plurality of conversion conditions based on a reference temperature and a current temperature detected by the detection unit. The detection unit detects the reference temperature in a case where the adjustment unit adjusts the emission light amount.

According to the present invention, density of an output image is controlled with high accuracy on the basis of a measurement result of a measurement image regardless of variation of internal temperature of the image forming apparatus.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
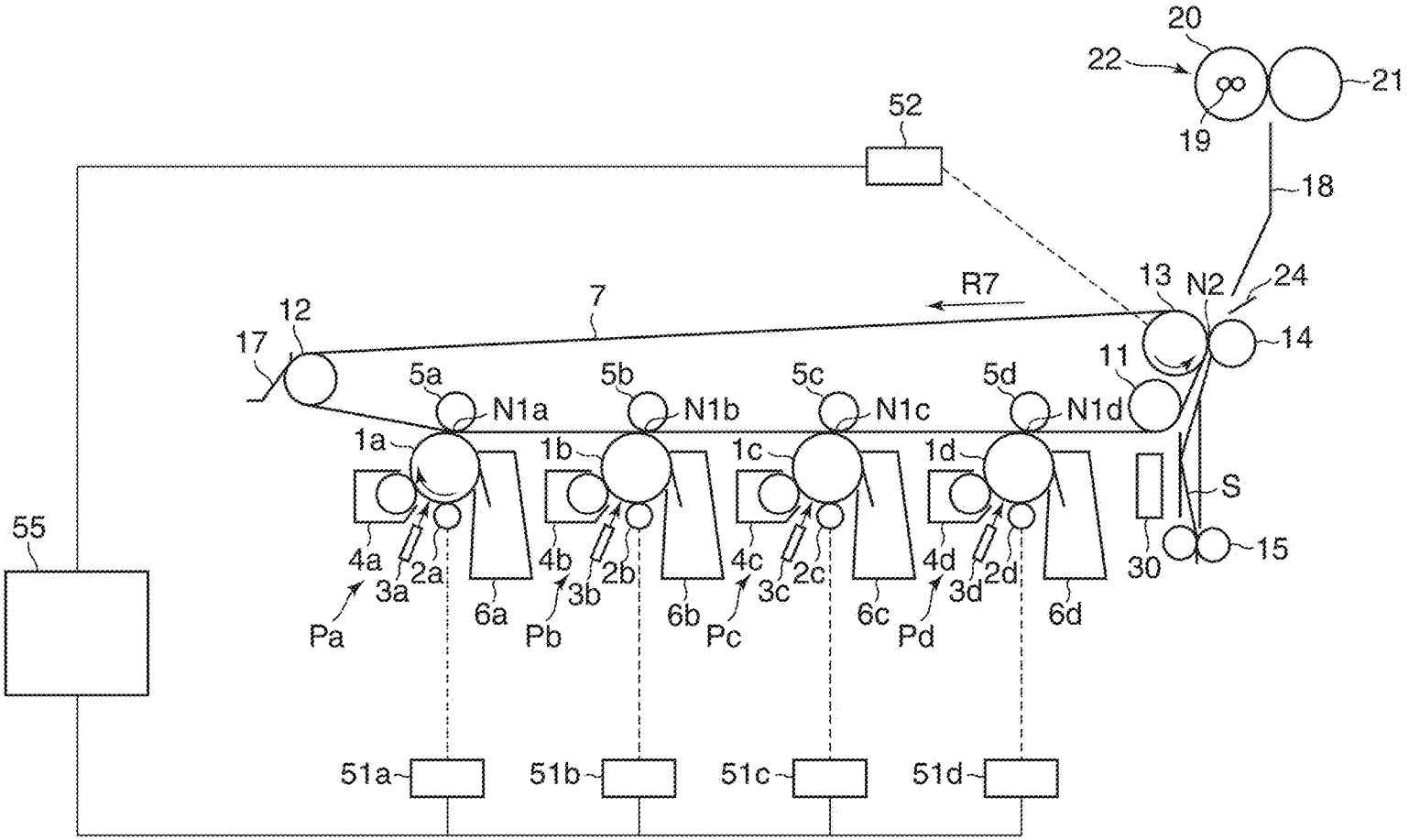
FIG. 1 is a sectional view showing an entire configuration of an image forming apparatus according to a first embodiment of the present invention.

FIG. 1 is a sectional view showing an entire configuration of an image forming apparatus according to a first embodiment of the present invention. This image forming apparatus is provided with four image forming units Pa, Pb, Pc, and Pd. These image forming units Pa, Pb, Pc, and Pd respectively form a yellow (Y) toner image, a magenta (M) toner image, a cyan (C) toner image, and a black (K) toner image.

The image forming units Pa, Pb, Pc, and Pd are respectively provided with photosensitive drums 1*a*, 1*b*, 1*c*, and 1*d*, charging rollers 2*a*, 2*b*, 2*c*, and 2*d*, exposure devices 3*a*, 3*b*, 3*c*, and 3*d*, development devices 4*a*, 4*b*, 4*c*, and 4*d*, primary transfer rollers 5*a*, 5*b*, 5*c*, and 5*d*, cleaning devices 6*a*, 6*b*, 6*c*, and 6*d*, and drum driving devices 51*a*, 51*b*, 51*c*, and 51*d*.

Figure 2:
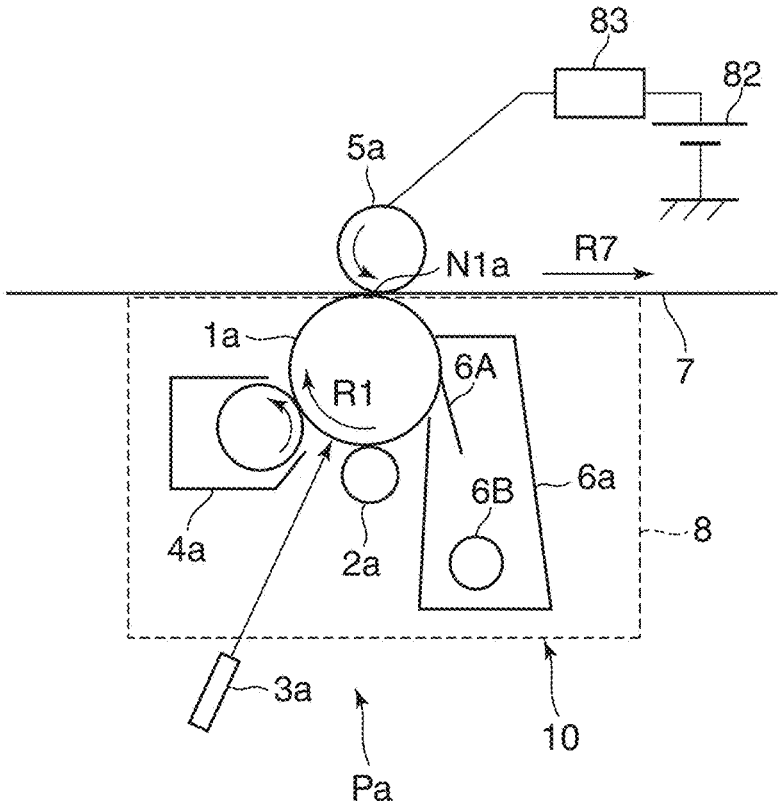
FIG. 2 is a sectional view showing one image forming unit in the image forming apparatus shown in FIG. 1.

FIG. 2 is a sectional view of the image forming unit Pa. Since basic configurations of the image forming units Pa, Pb, Pc, and Pd are common, the common configuration will be described with reference to FIG. 2.

The photosensitive drum 1*a* includes an aluminum cylinder and a photosensitive layer formed on a surface of the aluminum cylinder concerned. The photosensitive layer functions as a photosensitive member. The photosensitive drum 1*a* is rotated in an arrow R1 direction. The photosensitive drum 1*a*, charging roller 2*a*, development device 4*a*, and cleaning device 6*a* are integrally incorporated into a cartridge 8 (indicated by a dotted line in FIG. 2), and these constitute a process cartridge 10 as a whole. The process cartridge 10 is constituted for each color.

The surface of the photosensitive drum 1*a*, which is rotated by the drum driving device 51*a* (FIG. 1), is charged with the charging roller 2*a*. The exposure device 3*a* exposes the photosensitive drum 1*a* that has been charged to form an electrostatic latent image on the basis of image data sent from the controller 55 (FIG. 1). This electrostatic latent image is developed using toner by the development device 4*a*. It should be noted that an electrified polarity of the toner used is minus. The electrostatic latent image developed by the development device 4*a* is called a toner image. The toner image formed on the surface of the photosensitive drum 1*a* is transferred to a surface of an intermediate transfer belt 7 as an image bearing member by a primary transfer roller 5*a*. A transfer-bias applying unit 82 is controlled by a control device 83, and applies a primary transfer bias to the primary transfer roller 5*a*. Accordingly, the toner image on the photosensitive drum 1*a* is transferred to the intermediate transfer belt 7 at a primarily transferring nip position N1*a*. The primary transfer bias is direct current voltage (direct-current component), for example, and has the polarity contrary to the charging characteristic (regular electrified polarity) of the toner. The toner (residual toner) that remained on the surface of the photosensitive drum 1*a* without being transferred to the intermediate transfer belt 7 is removed by a cleaning blade 6A of the cleaning device 6*a*, and is collected to a waste toner container (not shown) by a waste-toner conveying screw 6B.

As shown in FIG. 1, the intermediate transfer belt 7 is looped over a backup roller 11, a driven roller 12, and a roller 13. The intermediate transfer belt 7 rotates in an arrow R7 direction because the roller 13 rotates by the belt driving device 52. The arrow R7 direction is a belt conveying direction. A secondary transfer roller 14 presses the intermediate transfer belt 7 to the roller 13. A secondary transfer nip position N2 is formed between the secondary transfer roller 14 and intermediate transfer belt 7. The yellow, magenta, cyan, and black toner images formed on the photosensitive drums 1*a*, 1*b*, 1*c*, and 1*d* are primarily transferred to the intermediate transfer belt 7 in order at the respective primarily transferring nip positions N1*a*, N1*b*, N1*c*, and N1*d* in order, and are piled up on the intermediate transfer belt 7.

The four-color toner image piled up on the intermediate transfer belt 7 is transferred to a sheet S by the secondary transfer roller 14. The sheet S used for image formation is stored in a sheet cassette (not shown). The sheet S is conveyed to a registration roller 15 by a conveyance device that has a feed roller, a conveying roller, a conveyance guide, etc. (not shown). Skew of the sheet is corrected by the registration roller 15, and then supplied to the above-mentioned secondary transfer nip position N2. When the sheet S passes the secondary transfer nip position N2, a secondary transfer high voltage power supply (not shown) applies a secondary transfer bias to the secondary transfer roller 14. The secondary transfer bias at this time has plus polarity contrary to the charging characteristics (minus) of the toner. This transfer bias secondarily transfers the four-color toner image to the sheet S collectively. The toner (residual toner) that remained on the intermediate transfer belt 7 without being transferred to the sheet S is removed by the belt cleaner 17 arranged at a position corresponding to the driven roller 12.

The sheet S to which the toner image was transferred secondarily is conveyed to a fixing device 22 along a conveyance guide 18. When the sheet S passes a fixing nip position, it is heated and pressurized by a fixing roller 20 and a pressure roller 21, which fixes the toner image onto the surface of the sheet S. Accordingly the image formation of full color (4 colors) to the sheet S is completed.

The backup roller 11 pushes up and supports the intermediate transfer belt 7 from an inner side of the intermediate transfer belt 7. As shown in FIG. 1, a reflective density sensor 30 is arranged near the outer circumferential surface of the intermediate transfer belt 7 at a downstream side of the primarily transferring nip position N1*d* of the image forming unit Pd. The density sensor 30 is mounted at the position that is approximately opposite to the backup roller 11 in the belt conveying direction across the intermediate transfer belt 7. The density sensor 30 is usually used when controlling a toner deposit amount so that a toner deposit amount (density) of an input image is reproduced on an output image faithfully. The density sensor 30 detects an amount of light reflected from a measurement image (hereinafter referred to as a toner patch T) formed on the outer circumferential surface of the intermediate transfer belt 7, and outputs the detected reflected light amount to the controller 55.

Figure 3:
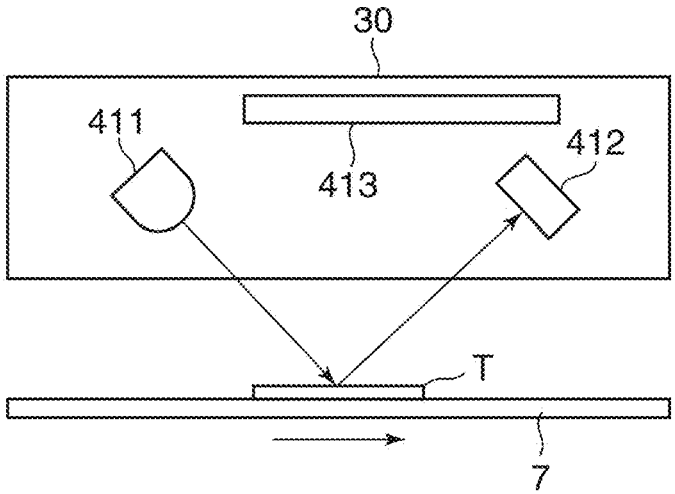
FIG. 3 is a view showing a configuration of a density sensor in the image forming apparatus shown in FIG. 1.

FIG. 3 is a view showing the configuration of the density sensor 30. The density sensor 30 has a light emitting component 411, such as LED, as an irradiation unit, a light receiving component 412, such as a photodiode, as an output unit, and an IC 413 that controls an emission light amount of the light emitting component 411. The light emitting component 411 is installed so as to irradiate with light at an angle of 45 degrees to the normal line of the intermediate transfer belt 7. The light receiving component 412 is installed at the symmetrical position of the light emitting component 411 centered at the normal line of the intermediate transfer belt 7. When the light emitting component 411 irradiates the intermediate transfer belt 7, the light is reflected by the surface of the intermediate transfer belt 7 or the toner patch T, and the light receiving component 412 receives the specular reflection light thereof. The light receiving component 412 outputs the signal on the basis of the light receiving result of the reflected light. FIG. 3 shows a state where the toner patch T is passing through a detection area of the density sensor 30. In order to detect flapping (a gloss unevenness and minute vibration) of a ground of the intermediate transfer belt 7 with sufficient sensitivity, it is suitable to use the specular reflection light thus.

The IC 413 controls an emission light amount (emission light intensity) of the light emitting component 411 by adjusting a light amount control value (applied voltage or driving current) supplied to the light emitting component 411 in the density sensor 30. When the emission light amount of the light emitting component 411 differs, the reflected light amount from the same target differs. That is, the reflected light amount from a target increases as the emission light amount increases.

A light amount level suitable for detecting toner patch density (strictly, reflected light level) is defined so that sufficient sensitivity is obtained to both of a low-density toner patch and a high-density toner patch. When the emission light amount of the light emitting component 411 is lowered, an absolute value of the reflected light amount from the low-density toner patch decreases and the low-density toner patch has tendency to become difficult to distinguish from the gloss unevenness on the surface of the intermediate transfer belt. Moreover, when the emission light amount of the light emitting component 411 increases, the high-density toner patch has tendency to dull sensitivity to change of density. Accordingly, the light amount level suitable for detecting toner patch density is preferably determined so that the reflected light amount of the low-density toner patch is distinguishable from the gloss unevenness of the ground and the reflected light amount of the high-density toner patch has sufficient sensitivity to change of density of the toner patch.

In order to set a suitable light amount level, the light amount control value is adjusted so that the reflected light amount from the ground (the surface of the intermediate transfer belt 7 on which no toner image is formed) of the intermediate transfer belt 7 matches a target light amount level. In the first embodiment, the light amount control value is set so that the output value of the density sensor 30 corresponding to the surface of the intermediate transfer belt 7 becomes 2.5 [V]. When the light amount level is adjusted in such a manner, appropriate control is available even if the glossiness of the belt surface varies.

Figure 4:
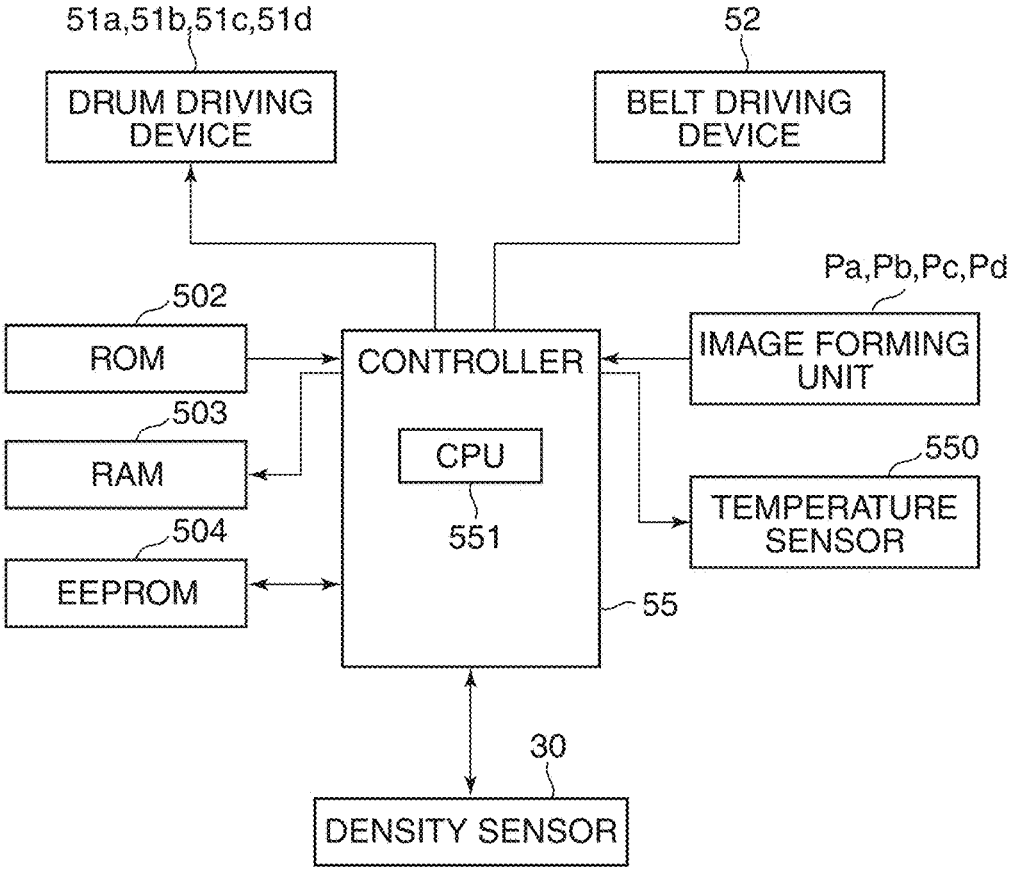
FIG. 4 is a block diagram schematically showing a control system of the image forming apparatus shown in FIG. 1.

FIG. 4 is a block diagram schematically showing a control system of the image forming apparatus. The controller 55 has a CPU 551, a timer (not shown), etc. The controller 55 controls each part of the image forming apparatus on the basis of a control program stored in a ROM 502 while using a RAM 503 as a working area. The ROM 502 stores the above-mentioned control program, various data, and various tables. The RAM 503 has a program load area, the working area of the controller 55, storage areas for the various data, etc. An EEPROM 504 stores an accumulated passing sheet count that is an accumulated number of sheets on which images were formed after turning the power of the apparatus ON. The controller 55 controls driving speeds (rotational velocities) of the drum driving device 51 and the belt driving device 52.

The reflected light amount (a signal corresponding to the light receiving result of the reflected light) detected with the density sensor 30 is supplied to the controller 55. Moreover, the controller 55 controls the IC 413 in the density sensor 30. A temperature sensor 550 as a detection unit measures environmental temperature and humidity of the image forming apparatus, and sends those data to the controller 55. When the data of temperature or humidity is required in the control, the controller 55 refers to the information sent from the temperature sensor 550.

Figure 5:
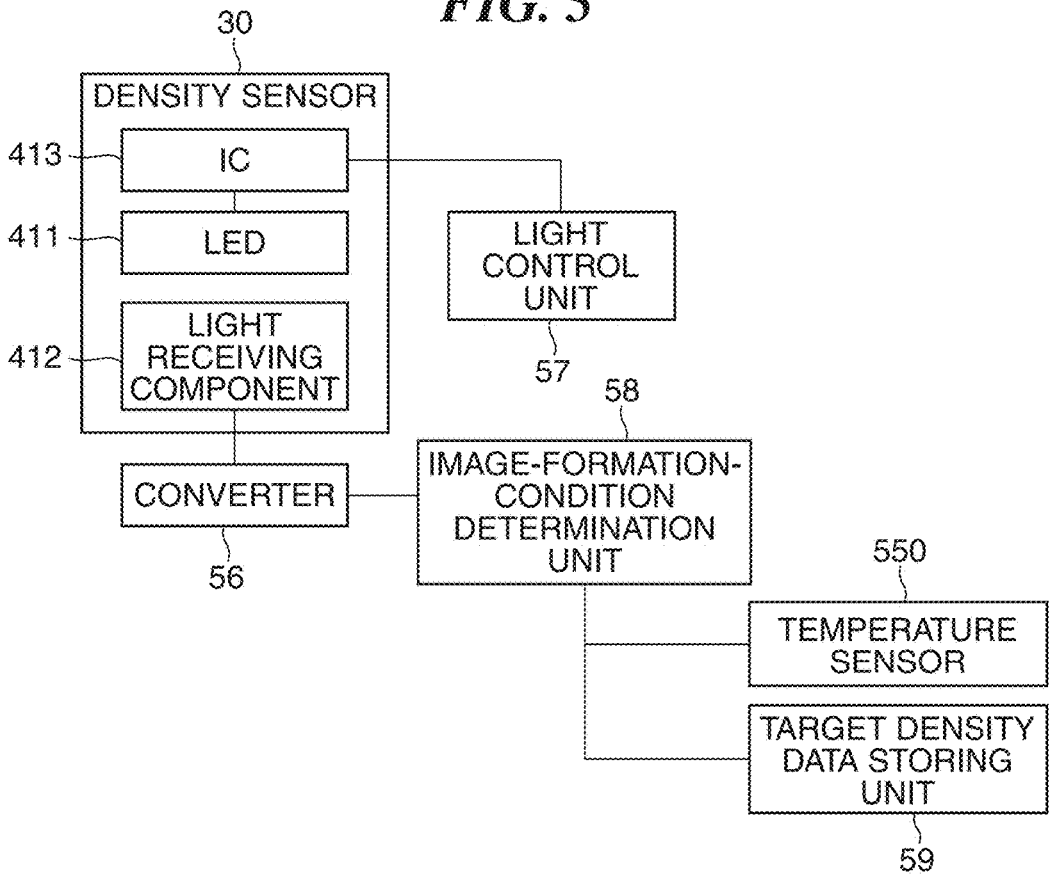
FIG. 5 is a block diagram showing details of the control system shown in FIG. 4.

FIG. 5 is a block diagram showing details of the control system shown in FIG. 4. A converter 56 and a light control unit 57 are connected to the density sensor 30. The temperature sensor 550 and a target density data storing unit 59 are connected to an image-formation-condition determination unit 58. Functions of the converter 56, light control unit 57, and image-formation-condition determination unit 58 are achieved by collaboration of the controller 55, ROM 502, RAM 503, and EEPROM 504. The ROM 502 (FIG. 4) corresponds to the target density data storing unit 59.

The light control unit 57 controls the intensity of the light emitted from the light emitting component 411 of the density sensor 30 by setting up the light amount control value. The converter 56 stores a plurality of (three in this example) luminance density conversion tables TBL1, TBL2, and TBL3 (mentioned later with reference to FIG. 10). The converter 56 converts the output signal (V) of the density sensor 30 into image density using the luminance density conversion table that is suitable for the atmosphere temperature of the image forming apparatus among the three luminance density conversion tables TBL1, TBL2, and TBL3. The luminance density conversion tables TBL1, TBL2, and TBL3 correspond to "conversion conditions". The target density data storing unit 59 has stored target density data nT (for example, nT=1.4). The image-formation-condition determination unit 58 finds for the laser beam intensity corresponding to the target density data nT using a density versus laser beam intensity table (mentioned later with reference to FIG. 11) generated from the value (image density) converted by the converter 56.

In the description, the laser beam intensity is a value that prescribes the laser powers of the exposure devices 3*a*, 3*b*, 3*c*, and 3*d*. The determination of the laser beam intensity is described as an example of the determination of the image formation conditions by the image-formation-condition determination unit 58 in the first embodiment. Thus, the image-formation-condition determination unit 58 controls the image formation conditions of the image forming units Pa, Pb, Pc, and Pd for the respective colors.

Incidentally, the luminance density conversion table used by the converter 56 is selected on the basis of the detection result of the temperature sensor 550. On the other hand, one value defined beforehand for each color is used as the target density data nT. Moreover, the light amount control value that controls the intensity of the light emitted from the light emitting component 411 is set up in step S202 in FIG. 13 mentioned later.

Figure 6:
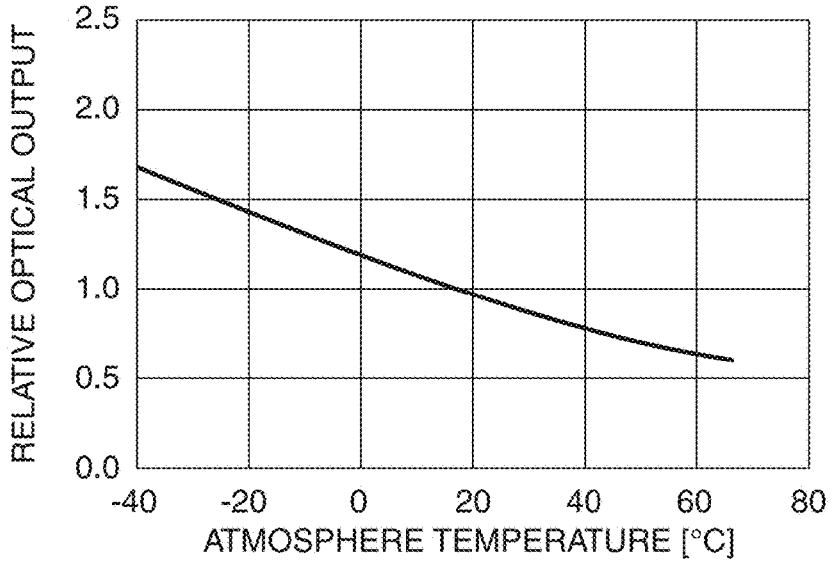
FIG. 6 is a graph showing an example of a temperature characteristic of the density sensor shown in FIG. 3.

FIG. 6 is a graph showing an example of a temperature characteristic of the density sensor. An optical output of the reflective density sensor relative to the peripheral temperature varies according to an individual configuration. As an example, about the density sensor 30 used in the first embodiment, assuming that a relative optical output amount is 1.0 when the temperature (atmosphere temperature) in the image forming apparatus is about 18 degrees Celsius, the relative optical output amount will become about 0.8 when the temperature is about 40 degrees Celsius. That is, even if the light emitting component 411 is driven using the same light amount control value, the actual emission intensity lowers as the peripheral temperature becomes higher.

Figure 7:
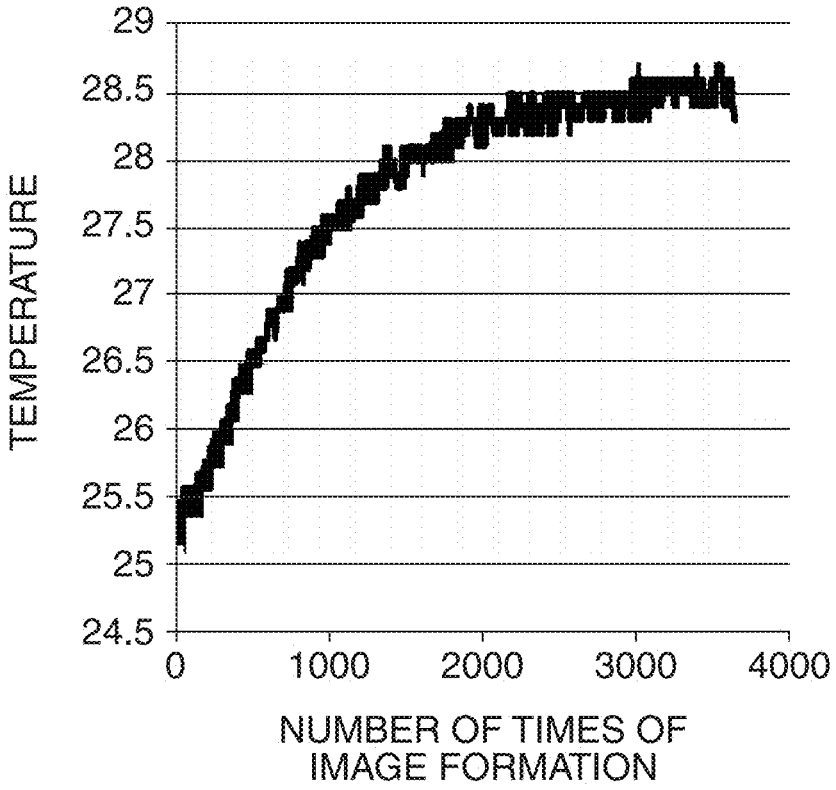
FIG. 7 is a graph showing transition of the atmosphere temperature in the image forming apparatus shown in FIG. 1.

FIG. 7 is a graph showing transition of the atmosphere temperature in the image forming apparatus. The atmosphere temperature in the image forming apparatus rises as the number of times of image formation increases. Accordingly, when the light emitting component 411 is continuously driven by the same light amount control value in the process in which the image formation is repeated, the reflected light amount received is lowered because the emission intensity is lowered. Then, when the density detection accuracy is lowered due to degradation of the reflected light amount, the density of the formed image is also affected.

Figure 8:
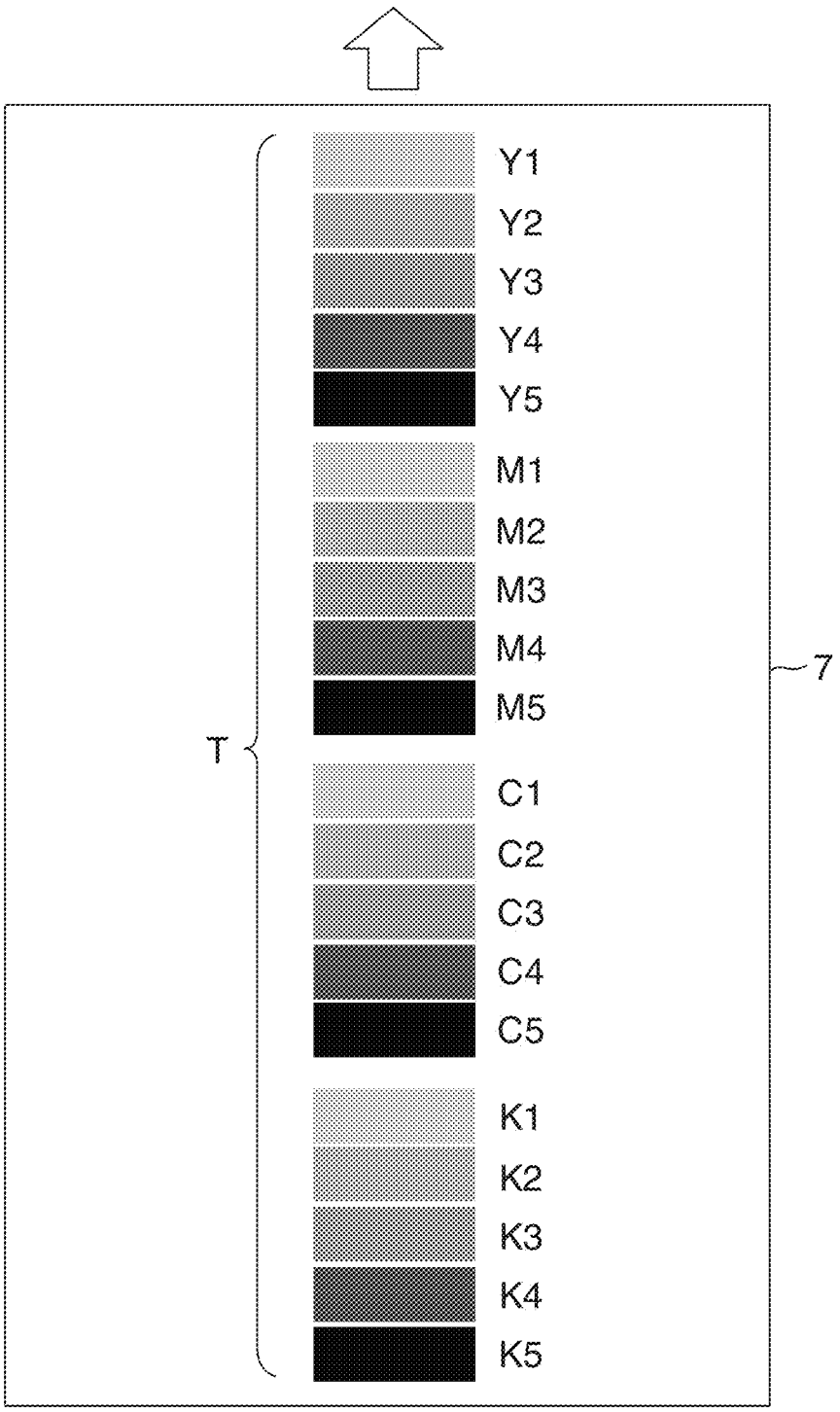
FIG. 8 is a view showing an example of a measurement image (toner patch) used when measuring density in the image forming apparatus shown in FIG. 1.

FIG. 8 is a view showing an example of the toner patch T formed on the intermediate transfer belt 7. The toner patch T is arranged in the center in the width direction of the intermediate transfer belt 7. The patterns of a plurality of gradations in yellow (Y), magenta (M), cyan (C), and black (K) are arranged in the belt conveying direction. In this example, the patterns of five gradations are formed for each color in order from thin density and in order of colors Y, M, C, and K. The print percentages of the respective patterns are 20%, 40%, 60%, 80%, and 100% in order from the thin pattern. For example, the yellow patterns are formed in order of Y1, Y2, Y3, Y4, and Y5.

Figure 9:
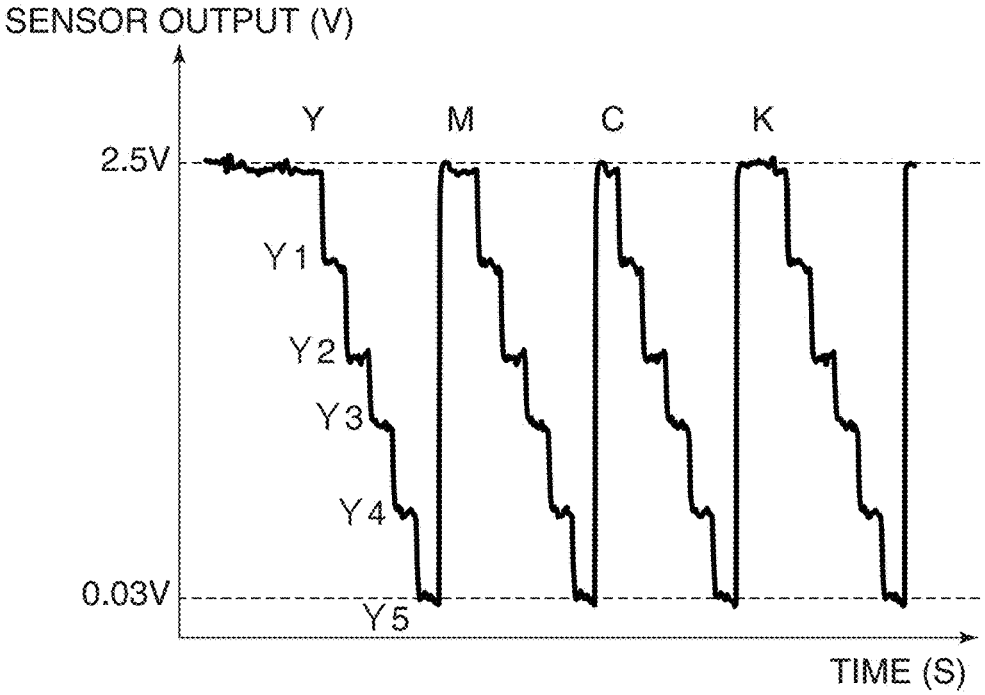
FIG. 9 is a graph showing an output of the density sensor that reads the toner patch shown in FIG. 8.

FIG. 9 is a graph showing an output of the density sensor 30 that reads the toner patch T. A horizontal axis represents time (S) and a vertical axis represents a sensor output (V). The controller 55 (light control unit 57) sets up the light amount control value so that the sensor output corresponding to the light reflected from the ground of the intermediate transfer belt 7 becomes 2.5 [V]. It should be noted that the controller 55 sets up the light amount control value, when the power of the image forming apparatus is turned ON and when the number of print pages becomes more than a first threshold, for example. On the other hand, the image formation conditions are determined when the number of print pages becomes more than a second threshold that is less than the first threshold. Then, when change of the atmosphere temperature of the image forming apparatus is more than a predetermined value at the time of determining the image formation conditions, the luminance density conversion table is updated. Accordingly, the frequency of updating the light amount control value of the density sensor 30 during the image forming operation is less than the frequency of measuring the toner patch with the density sensor 30. That is, the light amount control value of the density sensor 30 is not always changed whenever the toner patch is formed. This reduces downtime that occurs due to execution of the process for changing the light amount control value during the image forming operation, and enables to find the density of the toner patch with high accuracy even if the output value of the density sensor 30 varies due to change of the atmosphere temperature of the image forming apparatus.

Figure 10:
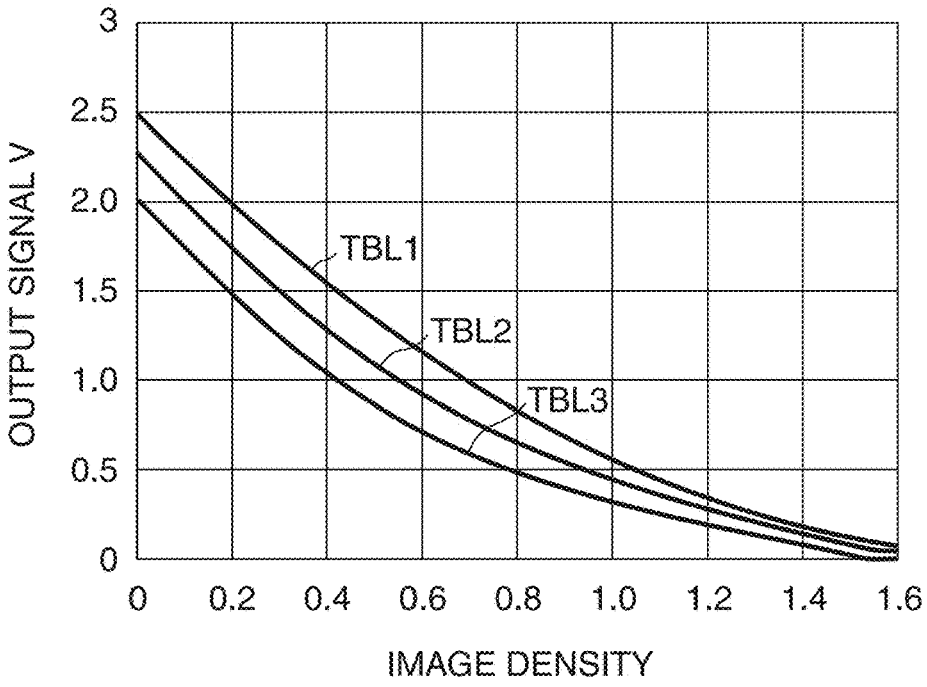
FIG. 10 is a graph showing examples of a plurality of luminance density conversion tables in the image forming apparatus shown in FIG. 1.

FIG. 10 is a graph showing an example of a plurality of luminance density conversion tables stored in the converter 56. Although the three luminance density conversion tables are stored in this example, two or more than four tables may be stored. The luminance density conversion table used by the converter 56 is selected on the basis of the change in the temperature detected by the temperature sensor 550. The luminance density conversion table TBL1 is selected in an initial setting. The luminance density conversion table TBL1 corresponds to a reference conversion condition. Although details will be mentioned later, the controller 55 switches the selected luminance density conversion table TBL1 to the luminance density conversion table TBL2 or TBL3, when the detected temperature increases gradually.

Figure 11:
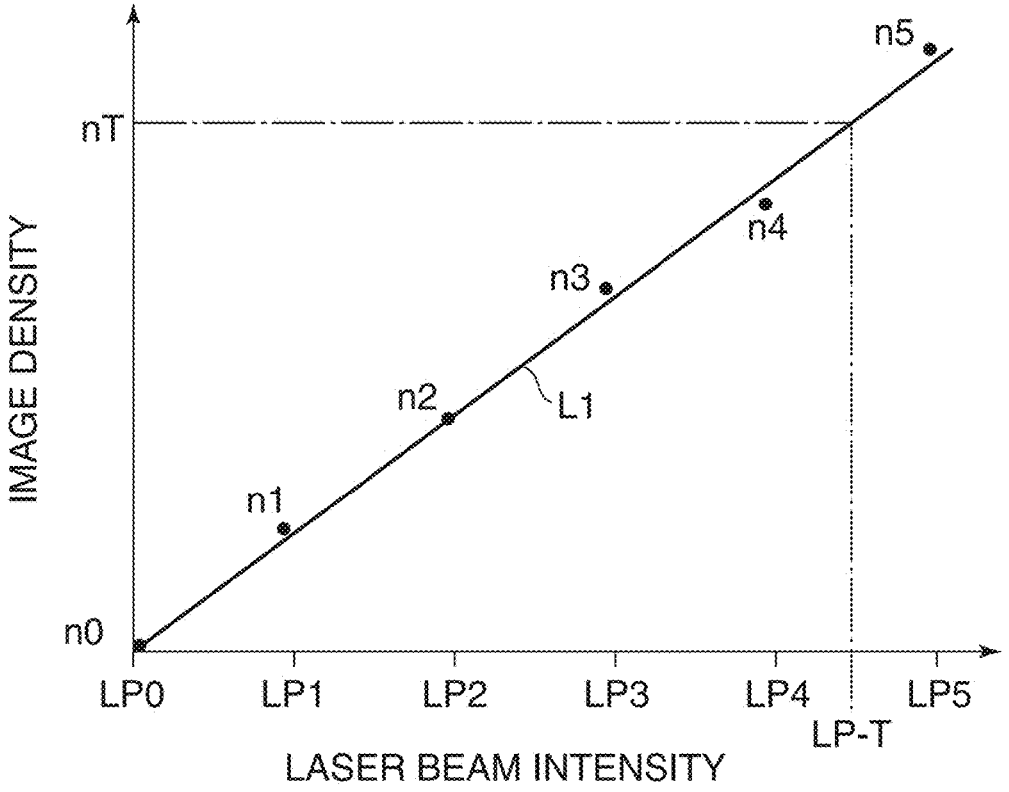
FIG. 11 is a graph showing an example of a density versus laser beam intensity table in the image forming apparatus shown in FIG. 1.

FIG. 11 is a graph showing an example of a density versus laser beam intensity table. A horizontal axis represents laser beam intensity, and a vertical axis represents image density. An example of yellow will be described. Symbols LP1, LP2, LP3, LP4, and LP5 in FIG. 11 respectively represent the laser beam intensities (light amount control values) of 20%, 40%, 60%, 80%, and 100% that are applied to the exposure device 3*a* when forming the patterns Y1, Y2, Y3, Y4, and Y5, respectively. Laser beam intensity LP0 means no emitting light. It is assumed that image densities n0, n1, n2, n3, n4, and n5 are obtained by converting the output signals of the density sensor 30 corresponding to the reflected lights from the ground of the intermediate transfer belt 7 and the patterns Y1, Y2, Y3, Y4, and Y5 using the selected luminance density conversion table. The controller 55 respectively plots the image densities n0, n1, n2, n3, n4, and n5 to the laser beam intensities LP0, LP1, LP2, LP3, LP4, and LP5 on the horizontal axis, and obtains a straight line L1 by linearly interpolating those points. Thus, the density versus laser beam intensity table is generated.

When the straight line L1 is obtained, the controller 55 finds the laser beam intensity corresponding to the target density data nT. The laser beam intensity LP-T is found in this example. In the following image formation, the controller 55 controls the exposure device 3*a* corresponding to an inputted image and the laser beam intensity LP-T.

Figure 12:
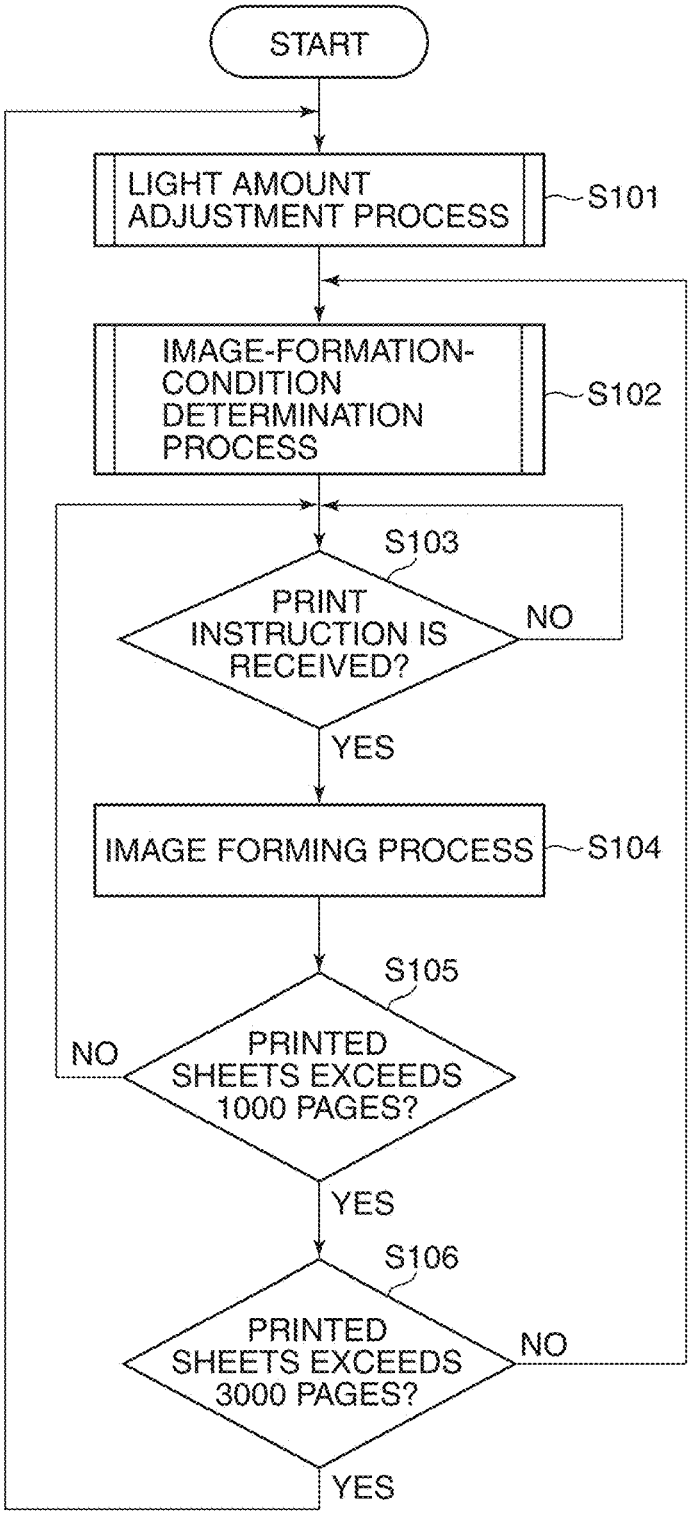
FIG. 12 is a flowchart showing an image forming process in the image forming apparatus shown in FIG. 1.

FIG. 12 is a flowchart showing the image forming process. The process of this flowchart is achieved when the CPU 551 of the controller 55 reads and runs a program stored in the ROM 502 etc. This process starts when device power is turned ON.

In step S101, the CPU 551 performs a light amount adjustment process first. Details of the light amount adjustment process will be described later with reference to FIG. 13. It should be noted that the CPU 551 stores the accumulated passing sheet count at the time of execution of this process into the RAM 503 in the step S101. In the next step S102, the CPU 551 performs an image-formation-condition determination process. Details of the image-formation-condition determination process will be described later with reference to FIG. 14. In the next step S103, the CPU 551 determines whether a print instruction is received. Then, the CPU 551 waits until receiving the print instruction. And when receiving the print instruction, the CPU 551 performs the image forming process corresponding to the input image by controlling the image forming units Pa, Pb, Pc, and Pd in step S104. At this time, the CPU 551 performs the image forming process while applying the image formation condition (laser beam intensity LP-T) determined in the step S102.

Next, the CPU 551 determines whether the number of print pages from the last execution of the step S101 became more than or equal to the second threshold in step S105. The second threshold is 1000 pages, for example. Then, when the number of print pages is less than the second threshold, the CPU 551 returns the process to the step S103. On the other hand, when the number of print pages became more than or equal to the second threshold, the CPU 551 determines whether the number of print pages from the last execution of the step S101 became more than or equal to the first threshold in step S106. The first threshold is more than the second threshold, and is 3000 pages, for example. Then, when the number of print pages is less than the first threshold, the CPU 551 returns the process to the step S102. On the other hand, when the number of print page becomes more than or equal to the first threshold, the CPU 551 returns the process to the step S101.

Accordingly, the image formation condition is not updated while the image formation sheet number from the last execution of the step S101 is less than 1000 pages. Moreover, the image formation condition may be updated in the step S102 (i.e., in the process in FIG. 14) while the image formation sheet number from the last execution of the step S101 is more than or equal to 1000 pages and is less than 3000 pages. Furthermore, whenever the image formation sheet number from the last execution of the step S101 becomes more than or equal to 3000 pages, the light amount control value is reset up, and a temperature A (first temperature) at the time of setting the light amount control value is updated in the step S101 (i.e., in the process in FIG. 13). It should be noted that the temperature A corresponds to a reference temperature.

Figure 13:
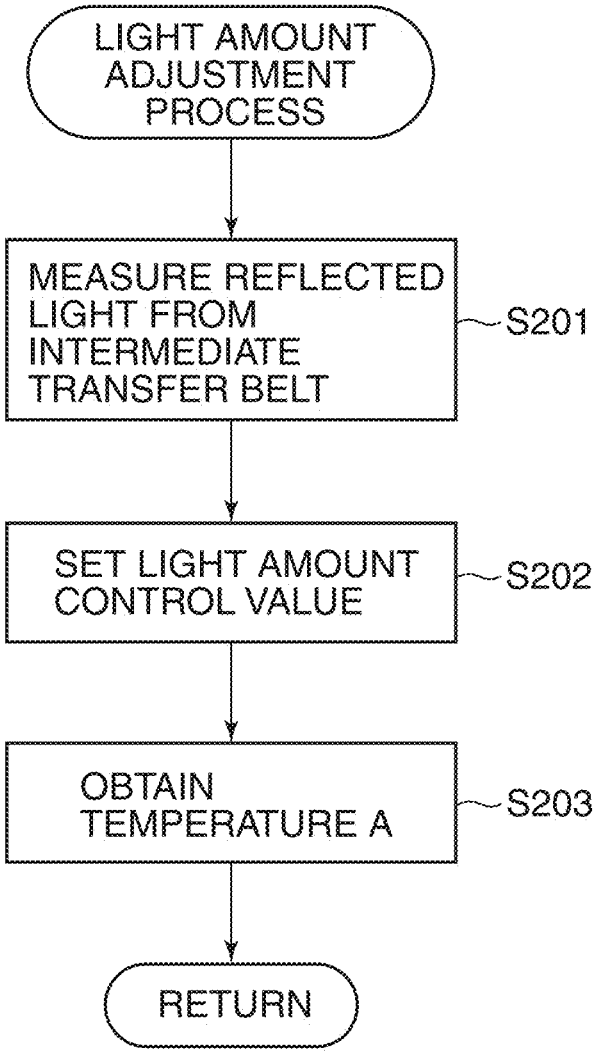
FIG. 13 is a flowchart showing a light amount adjustment process executed in the step S101 in FIG. 12.

FIG. 13 is a flowchart showing the light amount adjustment process executed in the step S101 in FIG. 12. First, the CPU 551 controls the density sensor 30 in step S201 to measure the reflected light from the ground of the intermediate transfer belt 7, and obtains the output value on the basis of the light reflected from the ground. In the next step S202, the CPU 551 sets up the light amount control value so that the output value on the basis of the above-mentioned light reflected from ground becomes 2.5 [V]. In the next step S203, the CPU 551 obtains the temperature detected by the temperature sensor 550 as the temperature A, and stores the temperature A into the RAM 503. Then, the process in FIG. 13 finishes.

A period from the start of the step S201 until the end of execution of the step S203 is referred to as a "first period". Accordingly, the first period includes not only a predetermined period after the power of the image forming apparatus is turned ON, but also a predetermined period after the image formation sheet number from the last setting of the light amount control value in the image-formation-condition determination process (FIG. 14) becomes more than or equal to the first threshold (3000 pages). In the process in FIG. 13, the CPU 551 plays a role as a setting unit that sets up the light amount control value.

Figure 14:
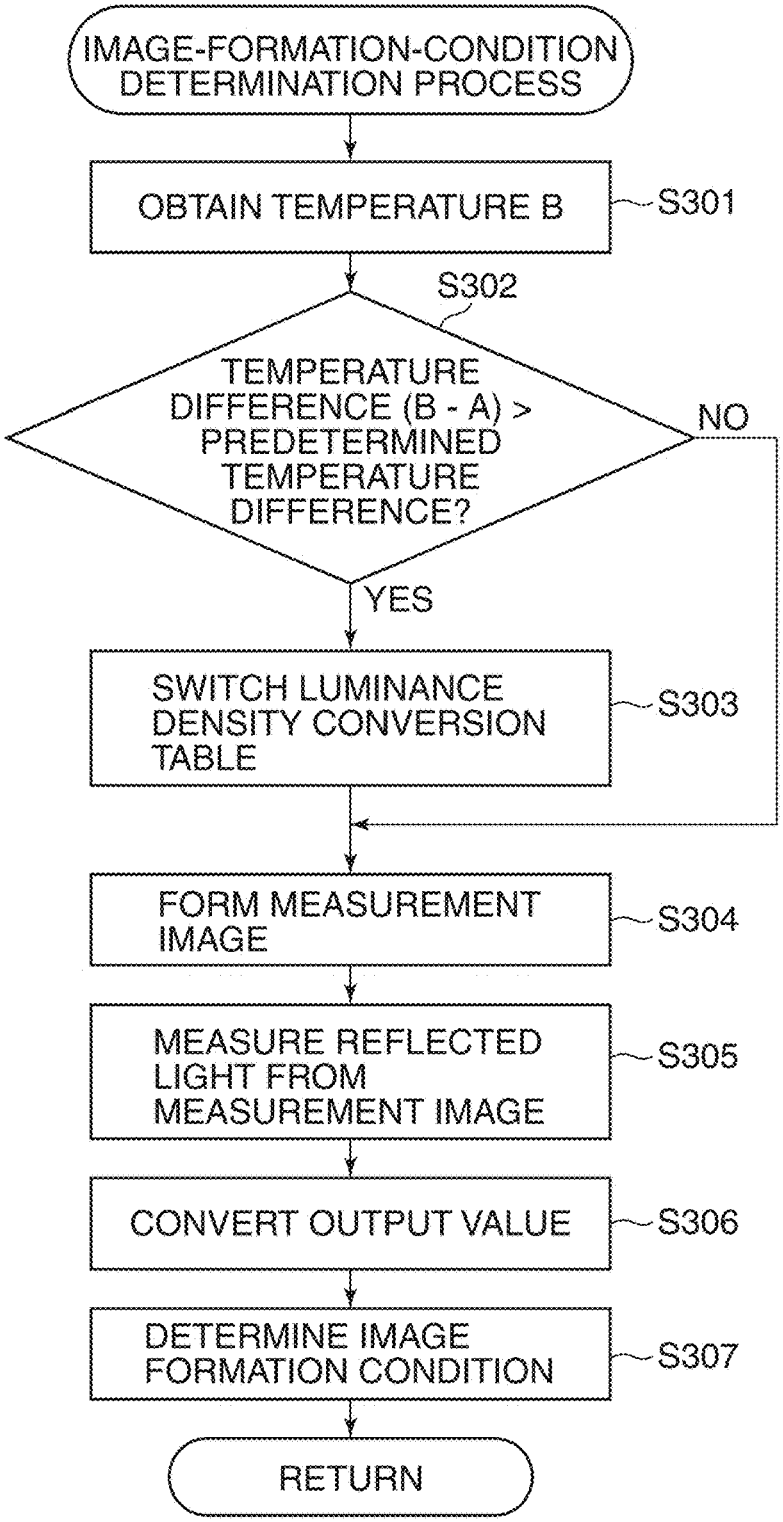
FIG. 14 is a flowchart showing an image-forming-condition determination process executed in the step S102 in FIG. 12.

FIG. 14 is a flowchart showing the image-forming-condition determination process executed in the step S102 in FIG. 12. First, the CPU 551 obtains the current temperature detected by the temperature sensor 550 as a temperature B (second temperature) in step S301. In the next step S302, the CPU 551 determines whether the temperature difference, which is a difference between the temperatures A and B (i.e., B−A), is more than a predetermined temperature difference. The predetermined temperature difference shall be 5 degrees Celsius. As a result of the determination, when the temperature difference is less than the predetermined temperature difference, the CPU 551 proceeds with the process to step S304. On the other hand, when the temperature difference is more than a predetermined temperature difference, the CPU 551 performs step S303 and proceeds with the process to the step S304. In the step S303, the CPU 551 switches the luminance density conversion table used corresponding to the temperature difference.

In the description, when the temperature difference is more than 5 degrees Celsius and is equal to or less than 10 degrees Celsius, the CPU 551 selects the table TBL2 as a table to be used from among the plurality of tables TBL1, TBL2, and TBL3 (FIG. 10). Moreover, when the temperature difference is more than 10 degrees Celsius, the CPU 551 selects the table TBL3 as a table to be used. It should be noted that the predetermined temperature difference is not limited to the exemplified value.

In the step S304, the CPU 551 controls the image forming units Pa, Pb, Pc, and Pd so as to form the measurement image (i.e., the toner patch T) on the intermediate transfer belt 7. Then, the CPU 551 controls the density sensor 30 to measure the reflected light from the toner patch T on the intermediate transfer belt 7, and obtains the output value. In the next step S306, the CPU 551 controls the converter 56 to convert the output value obtained in the step S305 into an image density value using the luminance density conversion table currently selected as a table to be used. In the next step S307, the CPU 551 determines the image formation conditions for the image forming units Pa, Pb, Pc, and Pd on the basis of the image density value that is obtained by conversion in the step S306. That is, the CPU 551 generates the density versus laser beam intensity table (FIG. 11) from the value (n0 through n5, etc.) that is obtained by converting the output signal of the density sensor 30 corresponding to the light reflected from the toner patch T using the table and the laser beam intensity (LP0 through LP5, etc.) as mentioned above. Then, the CPU 551 finds the laser beam intensity LP-T from the straight line L1 and the target density data nT in the created density versus laser beam intensity table, and stores it into the RAM 503. Then, the process in FIG. 14 finishes. This laser beam intensity LP-T is applied to a subsequent image forming process.

It should be noted that the predetermined period after starting the step S301 is referred to as a "second period". The second period is latter than the first period. The second period includes the predetermined period after the image formation sheet number from the last setting of the light amount control value becomes more than or equal to the second threshold (1000 pages).

In the process in FIG. 14, the CPU 551 plays a role of the control unit that controls the image formation condition and a role of the determination unit that determines the luminance density conversion table (conversion condition) to be used on the basis of the temperature difference. Moreover, the converter 56 plays a role of a conversion unit.

According to the first embodiment, the luminance density conversion table (conversion condition) to be used is determined on the basis of the first temperature (temperature A) detected in the first period and the second temperature (temperature B) detected in the second period. Accordingly, the density of the output image is controlled with high accuracy on the basis of the measurement result of the toner patch regardless of variation of the internal temperature of the image forming apparatus. Moreover, the frequency of the process for correcting the output of the density sensor 30 and the emission intensity of the light emitting component 411 on the basis of the measurement result of the toner patch is reduced as compared with that of the conventional technique. This reduces the variation of the image density resulting from change of the irradiation light amount of the density sensor due to a temperature change while lessening the time loss.

Moreover, since a conversion condition is selected from among the plurality of luminance density conversion tables, it is easy to process. Moreover, since the table will be switched if the temperature difference between the temperature A and temperature B is further expanded (exceeds 10 degrees Celsius) even after selecting the table, the density is appropriately detectable corresponding to a fine temperature change.

It should be noted that there are the three tables TBL1, TBL2, and TBL3 step by step as the luminance density conversion tables (FIG. 10), and the predetermined temperature difference (5 degrees Celsius) corresponds to a step between adjacent tables. However, the predetermined temperature difference shall be 2.5 degrees Celsius, for example, which is smaller than 5 degrees Celsius. In such a case, when the temperature difference between the temperature A and temperature B becomes more than 2.5 degrees Celsius, a new table between the table TBL1 and table TBL2 may be generated with interpolation and may be used. Accordingly, the conversion of the sensor output into the image density is capable of responding to a still finer temperature change.

Although the first embodiment exemplifies the configuration in which one luminance density conversion table is selected from among a plurality of luminance density conversion tables as a conversion condition to be used, the present invention is not limited to this. For example, the reference value stored in the ROM 502 as one standard conversion condition may be corrected on the basis of the temperature difference. The reference value is used for converting the sensor output into the image density, and is a value multiplied to the sensor output, for example. Moreover, a coefficient corresponding to the temperature difference may be multiplied or added to the reference value as a configuration of the correction, for example.

It should be noted that the temperature may fall after turning the device power ON. Accordingly, a table (for example, table TBL2) that is not an end side may be selected from among a plurality of tables as the table selected by the initial setting. Accordingly, the table 2 may be switched to the table TBL1.

Next, a second embodiment of the present invention will be described. The first embodiment exemplified the configuration that determines a luminance density conversion table in response to the temperature difference. On the other hand, the second embodiment shows a configuration that controls the image formation condition on the basis of the output data corresponding to the signal that represents a result of received light reflected from the toner patch and the target density data nT that is determined in response to the temperature difference between the temperature A and temperature B. The output data is the image density that is obtained by converting the sensor output using the luminance density conversion table (FIG. 10). Accordingly, the second embodiment is different from the first embodiment in the process in the step S303 in FIG. 14, and the other configurations are the same.

It should be noted that one luminance density conversion table (for example, the table TBL1 only in FIG. 10) is sufficient to be stored in the second embodiment. The target density data nT is data that represents the target concentration value. And candidates of the target density data nT are beforehand stored in the ROM 502 etc. as a plurality of target data candidates (for example, first, second, and third candidates). The initial setting is the first candidate. The value of the first candidate is more than the value of the second candidate that is more than the value of the third candidate.

In the step S303, the CPU 551 updates the target density data nT to be used in response to the temperature difference between the temperature A and temperature B. Specifically, when the temperature rises from the temperature A, the target density data nT becomes a small value. For example, when the temperature difference is more than 5 degrees Celsius and is equal to or less than 10 degrees Celsius, the CPU 551 determines the second candidate as the target density data nT by selecting the second candidate from the plurality of target data candidates. Moreover, when the temperature difference is more than 10 degrees Celsius, the third candidate is determined as the target density data nT to be used by selecting the third candidate.

According to the second embodiment, the density of the output image is controlled with high accuracy on the basis of the measurement result of the toner patch regardless of variation of the internal temperature of the image forming apparatus as with the first embodiment.

Although the second embodiment exemplified the configuration that the target density data nT is selected from among the plurality of target data candidates, the present invention is not limited to this. For example, a standard target data stored in the ROM 502 may be corrected on the basis of the temperature difference. The standard target data is used for converting the sensor output into the image density, and is a value multiplied to the sensor output, for example. Moreover, a coefficient corresponding to the temperature difference may be multiplied or added to the standard target data as a configuration of the correction, for example.

Next, a third embodiment of the present invention will be described. The third embodiment shows a configuration that controls the image formation condition on the basis of the output data corresponding to the signal that represents a result of received light reflected from the toner patch, while updating the light amount control value that prescribes the emission light amount of the light emitting component 411 according to the temperature difference between the temperature A and temperature B. Accordingly, the third embodiment is different from the first embodiment in the process in the step S303 in FIG. 14, and the other configurations are the same.

It should be noted that one luminance density conversion table (for example, the table TBL1 only in FIG. 10) is sufficient to be stored in the third embodiment. Moreover, the target density data nT is the same as what was shown in the first embodiment. Moreover, candidates of the light amount control value are beforehand stored in the ROM 502 etc. as a plurality of light amount control value candidates (for example, first, second, and third candidates). The initial setting is the first candidate. The value of the first candidate is less than the value of the second candidate that is less than the value of the third candidate.

In the step S303, the CPU 551 updates the light amount control value according to the temperature difference between the temperature A and temperature B. Specifically, when the temperature rises from the temperature A, the light amount control value is updated so as to increase the emission light amount of the light emitting component 411. For example, when the temperature difference is more than 5 degrees Celsius and is equal to or less than 10 degrees Celsius, the CPU 551 determines the second candidate as the light amount control value from among the plurality of light amount control value candidates. Moreover, when the temperature difference is more than 10 degrees Celsius, the third candidate is determined as the light amount control value.

Alternatively, a plurality of correction values for controlling a light amount may be stored beforehand in the ROM 502 etc. In such a case, the light amount control value may be updated by multiplying a correction value that is selected according to the temperature difference to the light amount control value.

According to the third embodiment, the density of the output image is controlled with high accuracy on the basis of the measurement result of the toner patch regardless of variation of the internal temperature of the image forming apparatus as with the first embodiment.

It should be noted that the conversion of the sensor output into the image density using the luminance density conversion table is not indispensable in the second and third embodiments. Accordingly, it is not indispensable to provide a luminance density conversion table. For example, the CPU 551 may generate a sensor-output versus laser-beam-intensity table in place of the density versus laser beam intensity table shown in FIG. 11, and may find the laser beam intensity LP-T on the basis of the sensor output using the sensor-output versus laser-beam-intensity table.

It should be noted that an image formation condition for an image forming unit may be an electrification potential, a development electric potential, etc. in an image forming process in each of the above-mentioned embodiments.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-076404, filed Apr. 6, 2016, which is hereby incorporated by reference herein in its entirety.

What is claimed is:

1. An image forming apparatus comprising:

an image forming unit configured to form an image on a sheet;

an image bearing member on which a measurement image is formed;

an emission unit configured to emit light to the image bearing member;

a light receiving unit configured to receive reflected light from the image bearing member and to generate an output value corresponding to the received reflected light from the image bearing member;

a controller configured to:

execute a light amount adjustment task to:

control the emission unit to emit light to the image bearing member when no image is formed on the image bearing member;

control the light receiving unit to receive reflected light from the image bearing member when no image is formed and generating a first output value corresponding to the received reflected light; and adjust a light emission amount of the emission unit based on the generated first output value; and execute an image-formation-condition determination task to:

control the image forming unit to form the measurement image;

control the emission unit to emit light to the image bearing member when the measurement image is formed on the image bearing member;

control the light receiving unit to receive the reflected light from the measurement image and generate a second output value corresponding to the received reflected light from the measurement image;

convert the second output value corresponding to the received reflected light from the measurement image to an image density value; and determine an image formation condition for the image forming unit based on the image density value; and a detection unit configured to detect temperature of the image forming apparatus, wherein the controller is further configured to select a conversion condition for converting the output value corresponding to the received reflected light to the image density value, from among a plurality of conversion conditions, based on a reference temperature detected by the detection unit when the controller executes the light amount adjustment task and a current temperature detected by the detection unit when the controller executes the image-formation-condition determination task.

2. The image forming apparatus according to claim 1, wherein the plurality of conversion conditions includes a reference conversion condition and another conversion condition that differs from the reference conversion condition, and wherein the controller is configured to convert the first output value corresponding to the received reflected light from the image bearing member to a reference image density based on the reference conversion condition and adjust the emission light amount based on the reference image density.

3. The image forming apparatus according to claim 2, wherein the controller is configured to control whether the reference conversion condition is selected based on the reference temperature and the current temperature.

4. The image forming apparatus according to claim 2, wherein the controller is configured to select the another conversion condition from among the plurality of conversion conditions in a case where a difference between the reference temperature and the current temperature is more than a threshold.

5. The image forming apparatus according to claim 1, wherein the plurality of conversion conditions includes a reference conversion condition and another conversion condition that differs from the reference conversion condition, and wherein the controller is configured to select the another conversion condition from among the plurality of conversion conditions in a case where a difference between the reference temperature and the current temperature is more than a threshold.

6. The image forming apparatus according to claim 1, wherein the controller is configured to control the detection unit to obtain the current temperature in a case where the image forming unit forms the measurement image.

7. The image forming apparatus according to claim 1, wherein the controller is configured to control the image forming unit to execute the image-formation-condition determination task after the number of sheets on which images were formed with the image forming unit exceeds a first predetermined number, and wherein the controller is configured to execute the light amount adjustment task after the number of sheets on which images were formed with the image forming unit exceeds a second predetermined number that is more than the first predetermined number.

8. An image forming apparatus comprising:

an image forming unit configured to form an image on a sheet;

an image bearing member on which a pattern image is formed;

an emission unit configured to emit light to the image bearing member;

a light receiving unit configured to receive reflected light from the pattern image on the image bearing member;

a detection unit configured to detect a temperature; and a controller configured to:

adjust emission light intensity of the emission unit;

control the image forming unit to form the pattern image;

control the emission unit to emit the light based on the adjusted emission light;

control the light receiving unit to receive the reflected light from the pattern image on the image bearing member;

generate information related to an image density of the pattern image from a light receiving result of the pattern image based on a current temperature detected by the detection unit and a reference temperature detected at the emission light intensity adjustment; and control an image forming condition based on the information related to the image density of the pattern image.

9. The image forming apparatus according to claim 8 further comprising:

a memory configured to store a plurality of generation conditions;

wherein the controller is configured to select, based on the current temperature and the reference temperature, a generation condition from among the plurality of generation condition, and wherein the controller is configured to generate the information related to the image density of the pattern image by converting the light receiving result of the pattern image based on the selected generation condition.

10. The image forming apparatus according to claim 8, wherein the controller is configured to adjust the emission light intensity in a case where power of the image forming apparatus is turned on, and wherein the controller is configured to control the image forming unit to form the pattern image when the image formation sheet number after the image pattern image has been last formed becomes more than or equal to a predetermined number.

11. The image forming apparatus according to claim 8, wherein the controller is configured to adjust the emission light intensity again when the image formation sheet number after the emission light intensity has been last adjusted becomes more than or equal to a first threshold, wherein the controller is configured to adjust the emission light intensity again when the image formation sheet number after the pattern image has been last formed becomes more than or equal to a second threshold, and wherein the second threshold is less than the first threshold.

12. The image forming apparatus according to claim 8, wherein the controller is configured to generate, so as to suppress an error of a light receiving result by the light receiving unit due to decrease of the emission light intensity of the emission unit, the information from the light receiving result of the pattern image based on the current temperature and the reference temperature.

* * * * *